United States Patent [19]

Mitchell

[11] 4,010,559

[45] Mar. 8, 1977

[54] ATHLETIC SHOE

[75] Inventor: Hal D. Mitchell, Shrewsbury, Mo.

[73] Assignee: A-T-O Inc., Willoughby, Ohio

[22] Filed: May 17, 1976

[21] Appl. No.: 687,192

[52] U.S. Cl. ..... 36/128

[51] Int. Cl.[2] ..... A43B 5/02

[58] Field of Search ..... 36/128, 129, 127, 126, 36/114, 115, 68, 69, 76 R, 28, 31

[56] References Cited

UNITED STATES PATENTS

| | | | |
|---|---|---|---|
| 1,118,920 | 12/1914 | Carpenter | 36/126 |
| 2,796,684 | 6/1957 | Montgomery | 36/128 |
| 3,273,266 | 9/1966 | Goldenberg | 36/128 |

*Primary Examiner*—Patrick D. Lawson

*Attorney, Agent, or Firm*—Koenig, Senniger, Powers and Leavitt

[57] ABSTRACT

A cleated athletic shoe having a special sole formation and a flexible arch section for reducing the danger of injury to the knee upon a lateral blow on the knee and for providing arch support when needed but freedom when arch support is not needed.

9 Claims, 6 Drawing Figures

ATHLETIC SHOE

BACKGROUND OF THE INVENTION

This invention relates to athletic shoes, and more particularly to cleated athletic shoes such as are used by football players.

In football, the knee has been highly susceptible to injury, particularly injury to the medial colateral ligaments and the medial meniscus to which they partially attach. It is believed that this type of injury is especially apt to occur upon a blow on the knee from the outside of the knee when the knee is locked in a substantially straight position, or when the heel cleats of the shoe are driven down into the ground by the player when, in running, he changes speed or direction. With the heel cleats locked into the ground, rotation in the hip joint is blocked, and any blow to the lateral aspect of the knee is dangerous to the medial ligaments and cartilage.

Shoes with various cleat patterns claimed to decrease the danger of damage to the knee have been in use, but it is believed that statistics re knee injuries to football players have not shown any superiority of such patterns, or one over another.

SUMMARY OF THE INVENTION

Among the several objects of the invention may be noted the provision of an improved cleated athletic shoe, particularly for football players, but also useful by players in other sports such as soccer and baseball, which is adapted to reduce the danger of injury to a player's knee upon a lateral blow upon the knee when his heel cleats are locked in the ground, by enabling the heel cleats readily to come out of the ground and thereby unblock rotation in the hip joint, or enabling the shoe readily to come off with the same effect; and the provision of such a shoe which is adapted to provide support for the arch of the foot when arch support is needed (e.g., when standing on the sole and heel of the foot) and to relax the support for the arch when arch support is not needed (e.g., when, during running or walking, the foot is raised), whereby the shoe may be referred to as a working shoe.

Generally, an athletic shoe of this invention comprises a sole and an upper, the sole having a heel section for the bottom of the heel of the foot, an arch section forward of the heel section for the bottom of the arch of the foot, and a front section forward of the arch section for the portion of the bottom of the foot forward of the arch and for the toes. The arch section and the heel section are so formed and positioned that, with the front section disposed on a generally flat horizontal surface, and the sole unstressed, the arch section extends upwardly and rearwardly from the rear end of the front section with its rear end raised above said surface, and the heel section extends upwardly and rearwardly from the rear end of the arch section, the heel section being raised above said surface and being inclined upwardly and rearwardly in the direction away from the rear end of the arch section relative to said surface and to the front section. The heel and front sections, which have cleats on the bottom thereof, are relatively stiff. The arch section is relatively flexible and resilient with respect to the heel and front sections, being adapted relatively readily to twist about an axis extending generally longitudinally of the shoe and to bend upon itself on an axis extending generally transversely of the shoe whereby, on a lateral blow upon the knee when the cleats on the heel and front sections are in the turf of a playing field, the heel section may readily flex upwardly via flexing of the arch section for withdrawal of the cleats on the heel from the turf to tend to avoid injury to the knee.

Other objects and features will be in part apparent and in part pointed out hereinafter.

BRIEF DESCRIPTION OF THE DRAWINGS

Corresponding reference characters indicate corresponding parts through the several views of the drawings.

DESCRIPTION OF THE PREFERRED EMBODIMENT

Figure 1:
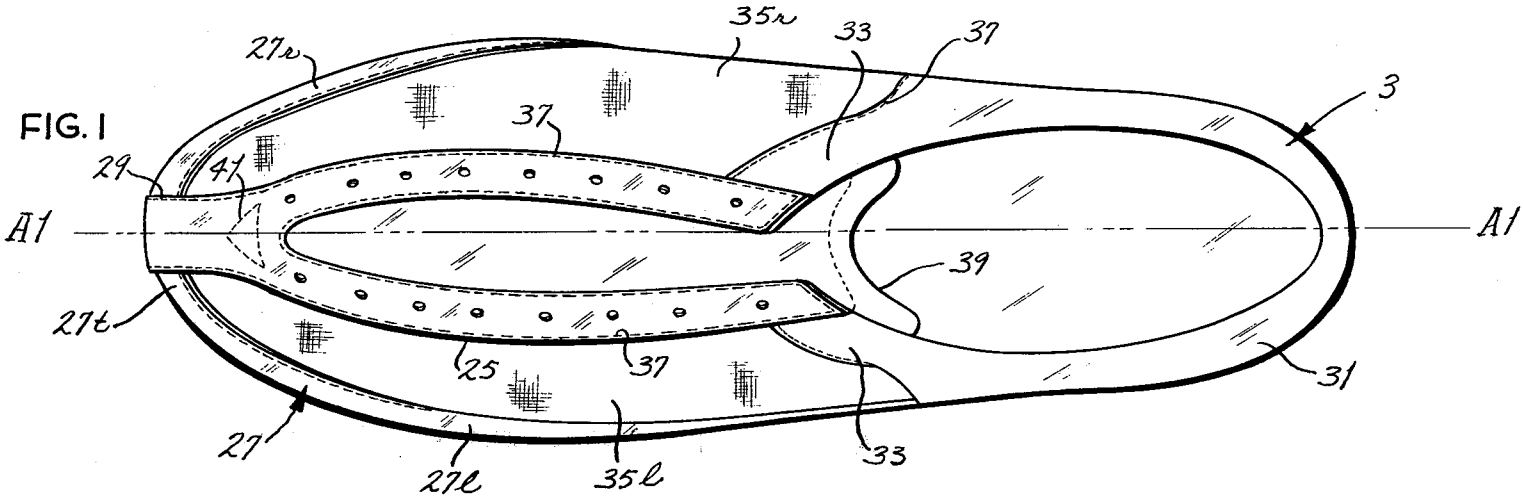
FIG. 1 is a top plan view of a shoe of this invention.

Referring to the drawings, a shoe made in accordance with this invention is shown to comprise a sole designated in its entirety by the reference numeral 1 and an upper designated in its entirety by the reference numeral 3. The sole has three distinct sections, namely, a heel section 5 for the bottom of the heel of the foot, an arch section 7 forward of the heel section for the bottom of the arch (the instep) of the foot, and a front section 9 forward of the arch section for the portion of the bottom of the foot forward of the arch and toes.

Figure 2:
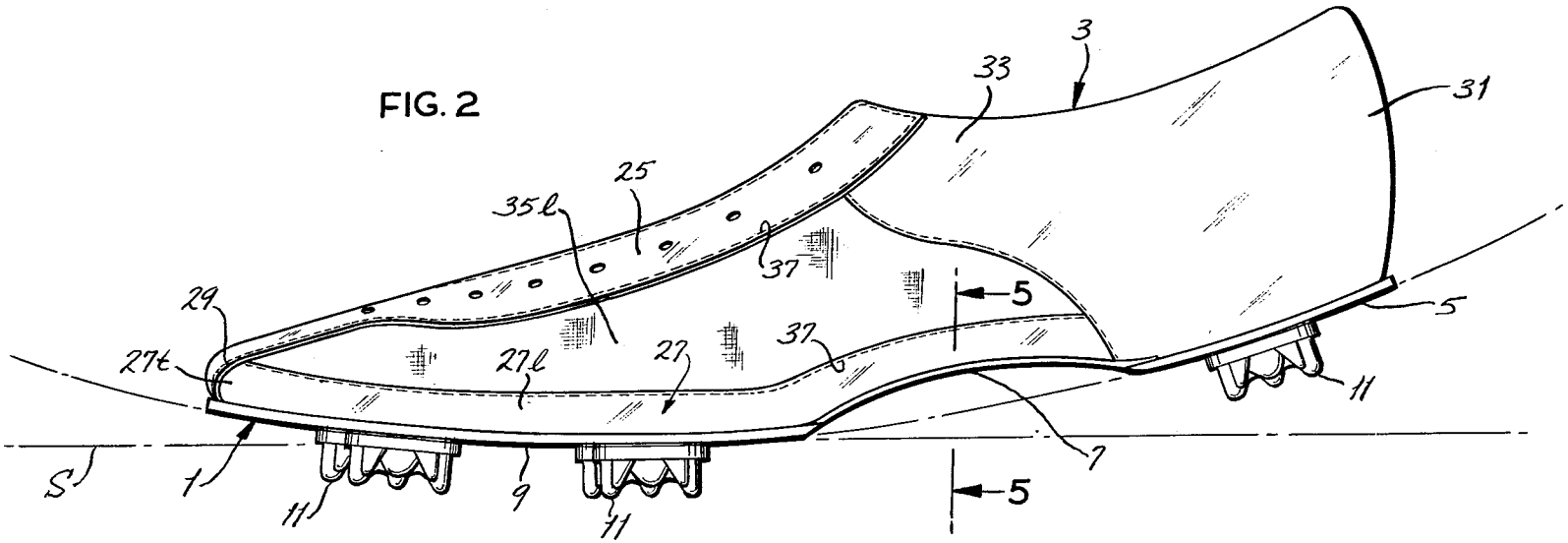
FIG. 2 is a side elevation of the FIG. 1 shoe.
Figure 3:
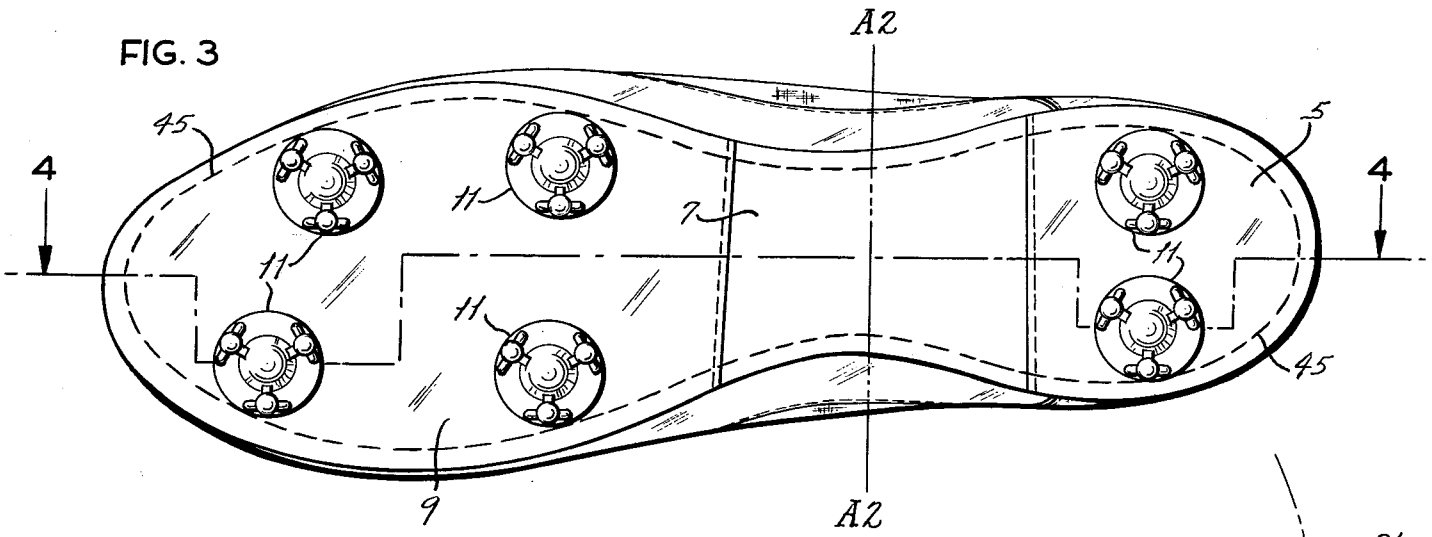
FIG. 3 is a bottom plan of the FIG. 1 shoe.
Figure 4:
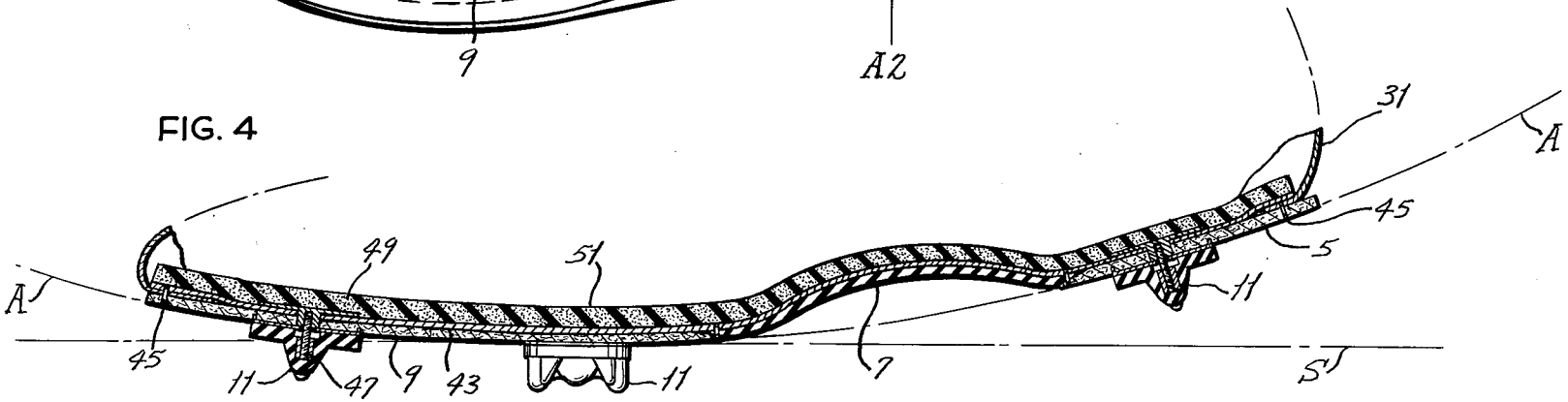
FIG. 4 is a longitudinal section generally on line 4—4 of FIG. 3.

The arch section 7 and heel section 5 are so formed and positioned that, with the front section 9 disposed on a generally flat surface indicated in phantom at S in FIGS. 2 and 4, and the sole unstressed, the arch section 7 extends upwardly and rearwardly from the rear end of the front section 9 with its rear end raised above the surface S, and the heel section 5 extends upwardly and rearwardly from the rear end of the arch section 7, the heel section being raised above the surface S and being inclined upwardly and rearwardly in the direction away from the rear end of the arch section 7 relative to surface S and to the front section 9. The heel section 5 and front section 9 have cleats 11 on the bottom thereof. The arch section 7 is relatively flexible and resilient with respect to the heel and front sections, being adapted relatively readily to twist about an axis A1 (see FIG. 1) extending generally longitudinally of the shoe and to bend upon itself on an axis A2 (see FIG. 3) extending generally transversely of the shoe, whereby, on a lateral blow upon the knee when the cleats on the heel and front sections are in the turf of a playing field, the heel section may readily flex upwardly via flexing of the arch section for withdrawal of the cleats on the heel from the turf to tend to avoid injury to the knee.

Figure 5:
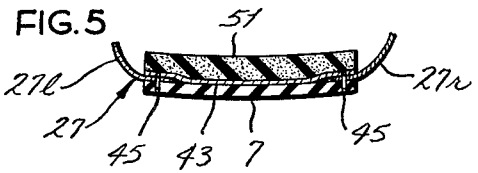
FIG. 5 is a transverse section generally on line 5—5 of FIG. 2.

Both the heel section 5 and front section 9 of the sole 1 are relatively stiff, being made of sole leather, or the like. The arch section comprises a relatively thin piece of an elastomeric material, preferably a relatively soft synthetic rubber having relatively high resistance to abrasion and a hardness number of about 60 – 70 on the Shore scale. Referring to FIG. 5, it will be seen that the arch section 7 is slightly convexly curved transversely of the shoe with respect to the outside (bottom) of the arch section. Referring to FIG. 4, it will be seen that, with the sole 1 unstressed and in its normal free condition, the heel section 5 is inclined relative to the surface S and the front section 9 at an angle corresponding generally to the angle made by the bottom of the heel of the foot with the ground during push off for sprinting, i.e., an angle of about 25°.

Figure 6:
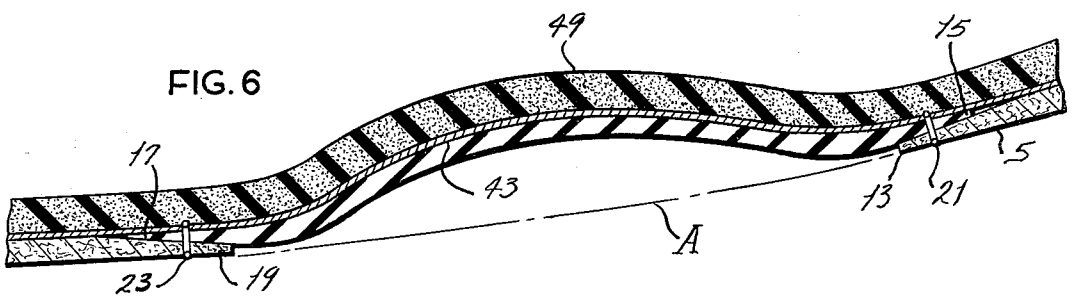
FIG. 6 is an enlarged fragment of FIG. 4.

As appears in FIG. 6, the forward end 13 of the heel section 5 is skived at the top and the rearward end 15 of the arch section 7 is skived at the bottom for lapping the end 15 over the top of the end 13, and the forward end 17 of the arch section 7 is skived at the bottom and the rearward end 19 of the front section 9 is skived at the top for lapping the end 17 over the top of the end 19. The skived rearward and forward ends 15 and 17 of the arch section are cemented on the skived forward end 13 of the heel section and the skived rearward end 19 of the front section and the cemented skived ends are also stitched together as indicated at 21 and 23 to form the sole. The heel section 5 and front section 9 are slightly convexly curved both longitudinally and transversely.

The shoe is made on a last the sole of which is formed to provide the inclination of the heel section relative to the front section. For example, the sole may be generally curved in an arc such as indicated at A in FIG. 4, curved on a center above the sole having a radius of about 14 inches for a size twelve shoe. The upper 3 comprises a soft leather lace yoke 25 extending back from the toe end of the sole above the front section 9 and partly over the arch section 7, and a leather welt 27 extending from the left forward side of the heel section 5 around the margin of the sole including its toe end to the right forward side of the heel section. This welt 27 constitutes a mud guard. Its toe end is designated **27*t* and its left and right side portions are designated 27*l* and 27*r* as illustrated in FIG. 1. The lace yoke 25 is stitched as indicated at 29 to the toe end 27*t* of the yoke. The upper 3 further includes a heel cup 31 which may comprise inside and outside soft leather layers with a stiff counter therebetween. The heel cup has upper forward extensions 33 extending to the upper ends of the sides of the lace yoke 25 and stitched thereto. The upper 3 further includes padded cloth, e.g., nylon, left and right side panels 35*l* and 35*r* between the sides of the lace yoke 25, the welt 27 and the heel cup. These panels extend over the inside of the welt and are stitched to the lace yoke, the welt and the heel cup as indicated at 37. A tongue 39 is stitched to the lace yoke at 41**.

A soft, flexible leather insole 43 (see FIGS. 4–6 ) is lasted on the sole 1 with margins of the welt 27 and heel cup 31 between this insole and the sole 1, and these component parts are stitched together as indicated at 45. The cleats 11 are fastened to the heel section 5 and the forward section 9 of the sole in any suitable conventional manner, as by being threaded on screws 47 extending from fittings 49 secured in the sole and the insole. A cushion 51 is cemented on the insole, covering the fittings 49. The cleats may be of any suitable conventional type, arranged in any suitable manner. As shown in FIG. 3, four cleats may be used on the front section 9 and two on the heel section 5.

The insole 43 and cushion 51 are soft and completely flexible, and are adapted to twist and bend with the flexible resilient arch section 7. When the athlete puts the shoe on and laces it up, the crown of the flexible arch section 7 (including the insole 43 and cushion 51) is pulled up into the arch of his foot. When downward pressure is applied at both heel and toe of the sole 1, as, for example, when the wearer is standing (thereby exerting downward pressure on both the forward section and heel section of the sole), downward rolling of the heel section 5 causes the flexible arch section 7 to be forced upwardly against the bottom of the instep or arch of the foot, thereby providing arch support. However, when the heel section is not subject to downward pressure (whenever the heel is raised) and the arch does not need support, the flexible arch section 7 relaxes and reduces the support in the arch. Thus, the flexible arch section 7 provides what may be regarded as a working action, increasing arch support when needed and decreasing it when not needed, for greater comfort and for reduction of what might otherwise impose restrictions on running.

With the intermediate portion of the sole 1 of the shoe constituted by the soft flexible resilient arch section 7 and the overlying portions of the highly flexible insole 43 and cushion 51, upon a lateral blow on the knee when the athlete has both heel and toe down and the heel cleats locked in the turf, the heel section 5 of the shoe may readily flex upwardly via flexing of the arch section for withdrawal of the heel cleats from the turf to tend to avoid injury to the knee. Or, with the flexible arch section 7, the shoe may more readily come off, with the same effect. Generally, the arch section 7 (with the overlying portions of the insole 43 and cushion 51) are so flexible and resilient that the heel section 5 may be flexed through about 180° relative to the front section 9 in either direction on the axis A2, and the heel section 5 may be twisted through about 180° relative to the front section 9 on the axis A1.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An athletic shoe comprising a sole and an upper, the sole having a heel section for the bottom of the heel of the foot, an arch section forward of the heel section for the bottom of the arch of the foot, and a front section forward of the arch section for the portion of the bottom of the foot forward of the arch and for the toes, the arch section and the heel section being so formed and positioned that, with the front section disposed on a generally flat horizontal surface, and the sole unstressed, the arch section extends upwardly and rearwardly from the rear end of the front section with its rear end raised above said surface, and the heel section extends upwardly and rearwardly from the rear end of the arch section, the heel section being raised above said surface and being inclined upwardly and rearwardly in the direction away from the rear end of the arch section relative to said surface and to the front section, the heel and front sections having cleats on the bottom thereof, the heel section and the front section being relatively stiff, the arch section being relatively flexible and resilient with respect to the heel and front sections, the arch section being adapted relatively readily to twist about an axis extending generally longitudinally of the shoe and to bend upon itself on an axis extending generally transversely of the shoe whereby, on a lateral blow upon the knee when the cleats on the heel and front sections are in the turf of a playing field, the heel section may readily flex upwardly via flexing of the arch section for withdrawal of the cleats on the heel from the turf to tend to avoid injury to the knee.

2. An athletic shoe as set forth in claim 1 wherein the arch section is convexly curved transversely of the shoe with respect to the outside of the arch section.

3. An athletic shoe as set forth in claim 1 wherein, with the sole unstressed, the heel section is inclined relative to said surface and front section at an angle corresponding generally to the angle made by the bottom of the heel of the foot with the ground during push off for sprinting.

4. An athletic shoe as set forth in claim 1 wherein, with the sole unstressed, the heel section is inclined relative to said surface and front section at an angle of about 25°.

5. An athletic shoe as set forth in claim 1 wherein, with the sole unstressed, the forward section and heel section lie generally in an arc curved on a center above the sole.

6. An athletic shoe as set forth in claim 1 wherein the heel section and the front section are made of leather or the like, and the arch section is made of an elastomeric material.

7. An athletic shoe as set forth in claim 6 wherein the forward end of the arch section is lapped over the top of the rear end of the front section and secured thereto, and the rear end of the arch section is lapped over the top of the forward end of the heel section and secured thereto.

8. An athletic shoe as set forth in claim 7 having a flexible insole secured within the shoe on the heel, arch and front sections of the sole.

9. An athletic shoe as set forth in claim 6 wherein the arch section is made of rubber having a hardness number of about 60 – 70 on the Shore scale.

* * * * *